US011365898B1

(12) United States Patent
Smith et al.

(10) Patent No.: US 11,365,898 B1
(45) Date of Patent: Jun. 21, 2022

(54) SYSTEMS AND METHODS FOR DETECTING A FAULT IN A CLIMATE CONTROL SYSTEM

(71) Applicant: Trane International Inc., Davidson, NC (US)

(72) Inventors: Christopher Blake Smith, Whitehouse, TX (US); Jonathan Edward Thrift, Tyler, TX (US)

(73) Assignee: Trane International, Inc., Davidson, NC (US)

( * ) Notice: Subject to any disclaimer, the term of this patent is extended or adjusted under 35 U.S.C. 154(b) by 20 days.

(21) Appl. No.: 16/900,670

(22) Filed: Jun. 12, 2020

(51) Int. Cl.

| | |
|---|---|
| ***F24F 11/38*** | (2018.01) |
| ***F24F 11/52*** | (2018.01) |
| ***F24F 11/61*** | (2018.01) |
| *F24F 110/12* | (2018.01) |

(52) U.S. Cl.
CPC ..... *F24F 11/38* (2018.01); *F24F 11/52* (2018.01); *F24F 11/61* (2018.01); *F24F 2110/12* (2018.01)

(58) Field of Classification Search
CPC .. F24F 11/38; F24F 11/52; F24F 11/61; F24F 2110/12
See application file for complete search history.

(56) References Cited

U.S. PATENT DOCUMENTS

| | | | |
|---|---|---|---|
| 4,574,871 | A | 3/1986 | Parkinson et al. |
| 7,072,727 | B1 * | 7/2006 | Davis ..... F24F 11/30 700/97 |
| 7,243,044 | B2 | 7/2007 | McCalla |
| 7,275,377 | B2 | 10/2007 | Kates |
| 7,343,226 | B2 | 3/2008 | Ehlers et al. |
| 8,452,457 | B2 | 5/2013 | Matsuoka et al. |
| 9,057,649 | B2 | 6/2015 | Steinberg et al. |
| 9,104,211 | B2 | 8/2015 | Fadell et al. |
| 9,939,333 | B2 | 4/2018 | Steinberg et al. |
| 10,042,341 | B1 * | 8/2018 | Jacob ..... E04B 1/92 |
| 10,139,123 | B2 | 11/2018 | Quam et al. |
| 10,248,113 | B2 | 4/2019 | Wacker |
| 10,352,602 | B2 | 7/2019 | Kates |
| 10,533,761 | B2 | 1/2020 | Barton et al. |
| 10,558,182 | B2 | 2/2020 | Wacker |
| 2010/0070234 | A1 | 3/2010 | Steinberg et al. |

(Continued)

OTHER PUBLICATIONS

"Allison Bailes,,We Are the 99%—And the 1%, May 16, 2012, Green Building Advisor, https://www.greenbuildingadvisor.com/article/we-are-the-99-and-the-1" (Year: 2012).*

*Primary Examiner* — Santosh R Poudel
(74) *Attorney, Agent, or Firm* — Womble Bond Dickinson (US) LLP

(57) ABSTRACT

Methods and related systems of detecting a fault in a heating, ventilation, and air conditioning (HVAC) system are disclosed. In an embodiment, the method includes determining an expected runtime of the HVAC system required to achieve a temperature setpoint in a comfort zone of the HVAC system following a triggering event, wherein the expected runtime is based on a design temperature of a geographic location at which the HVAC system is installed. Additionally, the method includes monitoring a current runtime of the HVAC system elapsed following the triggering event, and comparing the expected runtime with the current runtime of the HVAC system elapsed following the triggering event.

16 Claims, 5 Drawing Sheets

(56) References Cited

U.S. PATENT DOCUMENTS

| | | | | |
|---|---|---|---|---|
| 2010/0256958 | A1* | 10/2010 | Yoo | F24F 11/30 703/2 |
| 2012/0016524 | A1 | 1/2012 | Spicer et al. | |
| 2012/0080531 | A1* | 4/2012 | Li | G05D 23/1902 236/47 |
| 2013/0158717 | A1 | 6/2013 | Zywicki et al. | |
| 2014/0371917 | A1* | 12/2014 | Rite | F24F 11/30 700/276 |
| 2016/0138819 | A1* | 5/2016 | Vega | F24F 11/30 700/276 |
| 2019/0137134 | A1* | 5/2019 | Koop | G06F 30/00 |
| 2019/0219292 | A1* | 7/2019 | Davis | G06Q 30/0629 |
| 2019/0234638 | A1* | 8/2019 | Song | F24F 11/62 |

* cited by examiner

SYSTEMS AND METHODS FOR DETECTING A FAULT IN A CLIMATE CONTROL SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

A climate control system, such as a heating, ventilation, and air conditioning (HVAC) system, may control the environmental conditions (e.g., temperature, relative humidity, etc.) of an indoor space. Some climate control systems may be split-type heat pump systems that have an indoor air handling unit and an outdoor unit and are capable of cooling a comfort zone by operating in a cooling mode for transferring heat from the comfort zone to an ambient area. Some split-type heat pump systems are also capable of heating the comfort zone by operating in a heating mode for transferring heat from the outdoor ambient area to the comfort zone by reversing the flow of refrigerant through the climate control system.

BRIEF SUMMARY

Some embodiments disclosed herein are directed to a method of detecting a fault in a heating, ventilation, and air conditioning (HVAC) system. In an embodiment, the method includes determining an expected runtime of the HVAC system required to achieve a temperature setpoint in a comfort zone of the HVAC system following a triggering event, wherein the expected runtime is based on a design temperature of a geographic location at which the HVAC system is installed. Additionally, the method includes monitoring a current runtime of the HVAC system elapsed following the triggering event, and comparing the expected runtime with the current runtime of the HVAC system elapsed following the triggering event.

Other embodiments disclosed herein are directed to a non-transitory machine-readable medium. In an embodiment, the non-transitory machine-readable medium includes instructions that, when executed by a processor, cause the processor to determine an expected runtime of a heating, ventilation, and air conditioning (HVAC) system required to achieve a temperature setpoint in a comfort zone of the HVAC system elapsed following a triggering event, wherein the expected runtime is based on a design temperature of a geographic location at which the HVAC system is installed. In addition, the instructions, when executed by the processor, further cause the processor to monitor a current runtime of the HVAC system elapsed following the triggering event, and compare the expected runtime with the current runtime of the HVAC system elapsed following the triggering event.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
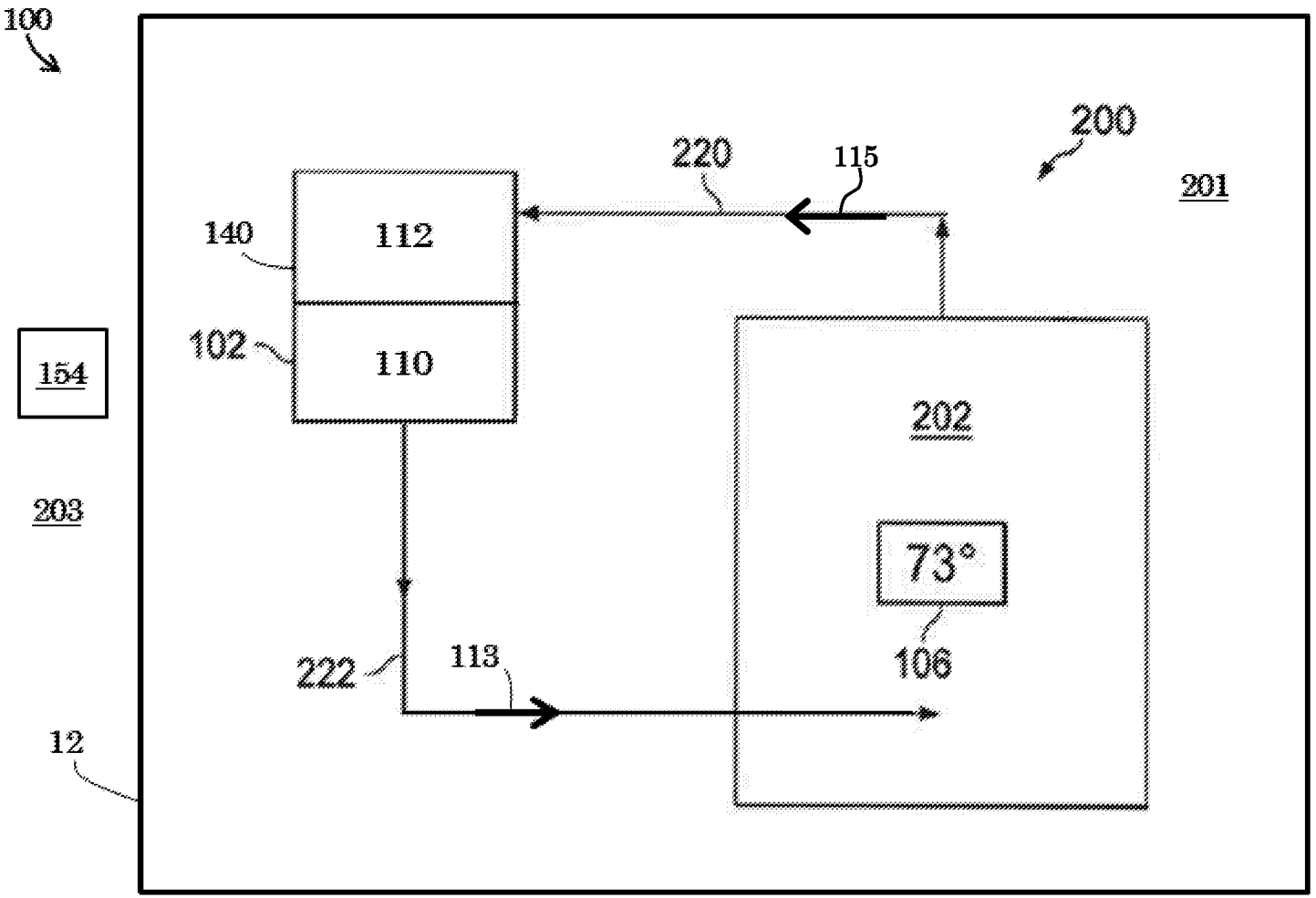
FIG. 1 is a schematic diagram of an air circulation path of a climate control system according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Further, when used herein (including in the claims), the words "about," "generally," "substantially," "approximately," and the like mean within a range of plus or minus 10% unless otherwise stated herein.

As previously described, climate control systems, which may comprise split-type heat pump systems, furnaces, boilers, radiant heat, ground source heat-pumps and/or cooling only systems, may cool the comfort zone while in a cooling mode by transferring heat from the comfort zone to an outdoor ambient environment surrounding the indoor space. The climate control system may also transfer heat from the ambient environment to the comfort zone while in a heating mode by reversing a direction of flow of refrigerant through the climate control system (e.g., through an indoor unit and an outdoor unit of the climate control system). The climate control system may also provide heating to the comfort zone by operating a gas-fired furnace and/or electric heating element of the climate control system. The climate control system may provide cooling or heating to the comfort zone in order to achieve a temperature setpoint in the comfort zone, where the temperature setpoint may be defined by a user of the climate control system (e.g., a homeowner, a technician equipped to service the climate control system, etc.).

Faults may occur in the climate control system during the climate control system's operational life. For example, during the operational life of the climate control system, some of the capacity or amount of cooling and/or heating which the climate control system may provide may be lost for numerous reasons. For example, a fault may occur in the climate control system due to loss of refrigerant, a malfunctioning compressor or other component of the climate control system, loss of indoor or outdoor airflow, etc.

The amount of time required for the climate control system to achieve a user defined temperature setpoint of the comfort zone through cooling or heating the indoor space may increase in response to a loss of cooling and/or heating capacity from the climate control system. The increased amount of time the climate control system must operate in the cooling or heating modes to achieve the temperature setpoint of the comfort zone may reduce the energy efficiency of the climate control system as well as lead to discomfort of the user of the climate control system. Additionally, the fault in the climate control system resulting in the increased amount of time required for the climate control system to achieve the temperature setpoint may be temperature-dependent and/or intermittent and thus may only occur at times when the comfort zone of the indoor space is unoccupied. For instance, the fault may occur intermittently during daytime hours when a user of the climate control system (e.g., a homeowner) is away at work, making the loss of capacity difficult to detect by the user.

Accordingly, embodiments disclosed herein include systems and methods for detecting a fault in a climate control system by comparing an expected runtime to achieve a temperature setpoint in the comfort zone with a current runtime of a climate control system elapsed following a triggering event, where the expected runtime may be based on an outdoor ambient temperature and a design temperature of a geographic location at which the climate control system is installed.

Additionally, some embodiments include a system and method for issuing an alert to a user of the climate control system notifying the user of a fault in the climate control system indicated by the current runtime of the climate control system elapsed following the triggering event exceeding the expected runtime and the temperature setpoint having not been achieved in the comfort zone. As described further herein, by basing the expected runtime on the outdoor ambient temperature and the design temperature of the geographic location, false alerts erroneously indicating a fault in the climate control system may be avoided in situations where the outdoor ambient conditions exceed the expected cooling and/or heating capacity of the climate control system.

Referring now to FIG. 1, a schematic diagram of an air circulation path 200 of a climate control system 100 is shown according to an embodiment of the disclosure. In this embodiment, climate control system 100 is an HVAC system, and thus, system 100 may be referred to herein as HVAC system 100. Most generally, HVAC system 100 comprises a heat pump system that may be selectively operated to implement one or more substantially closed thermodynamic refrigeration cycles to provide a cooling functionality (the "cooling mode") and/or a heating functionality (the "heating mode").

Air circulation path 200 of HVAC system 100 extends through an indoor space 201 disposed within an external structure 12. An outdoor temperature sensor 154 of HVAC system 100 may be positioned in the ambient area 203 proximal to structure 12 whereby HVAC system 100 may determine and monitor the outdoor ambient temperature in ambient area 203.

Figure 5:
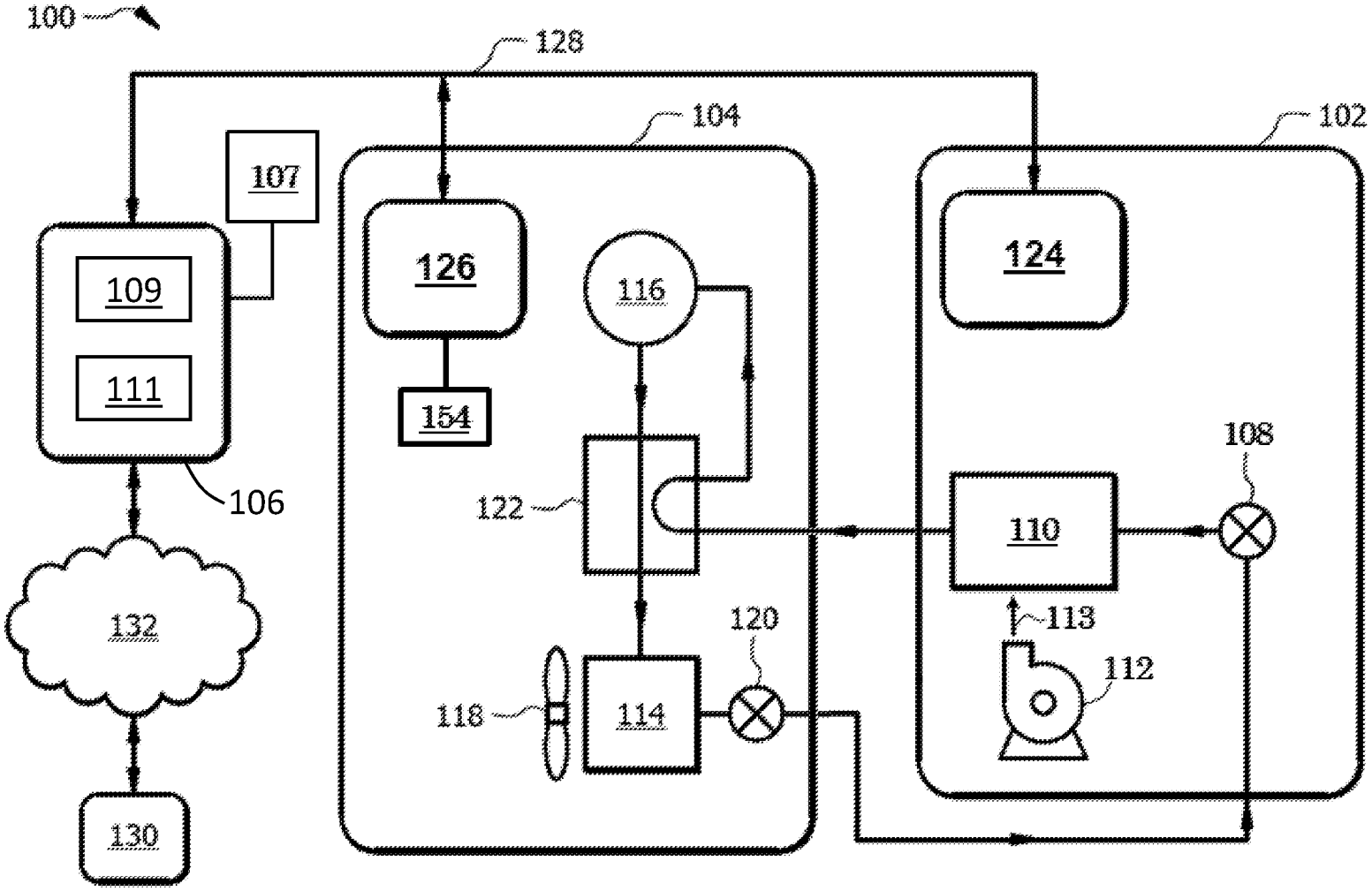
FIG. 5 is a diagram of the climate system of FIG. 1 configured for operating in a cooling mode according to some embodiments.

Indoor space 201 may include a comfort zone 202 positioned therein. It will be appreciated that while a single comfort zone 202 is shown, any number of zones may be present in an indoor space 201 or structure 12. Where present, the plurality of zones may be conditioned independently or together in one or more groups. The air circulation path 200 of the HVAC system 100 may generally comprise a return duct 220 and a supply duct 222. The air circulation path 200 also passes through an air handler 140 of an indoor unit 102 of HVAC system 100, which may include, among other components, an indoor fan 112, and an indoor heat exchanger 110. Indoor unit 102, along with other components of HVAC system 100, are shown in FIG. 5 and are described in further detail below.

In operation, the indoor fan 112 may be configured to generate a supply airflow 113 through air handler 140 to deliver temperature conditioned air from an air supply opening in the indoor unit 102, through supply duct 222, and to comfort zone 202 in response to a temperature or humidity sensed by at least one indoor temperature sensor and/or humidity sensor carried by at least one of a system controller 106 of HVAC system 100, a zone thermostat positioned in comfort zone 202, and/or a sensor positioned in comfort zone 202. Air from comfort zone 202 may return as a return airflow (indicated by arrow 115 in FIG. 1) to the air handler 140 through return duct 220 and an air return opening in the air handler 140. Air entering the indoor air handler 140 through the air return opening may then be conditioned for delivery to comfort zone 202 as described above. Circulation of the air in this manner may continue repetitively until the temperature and/or humidity of the air within comfort zone 202 conforms to a target temperature as required by, for example, system controller 106. The target temperature of air within comfort zone 202 may comprise a temperature setpoint entered into an input/output (I/O) unit 107 (shown in FIG. 5) of HVAC system 100 by a user of HVAC system 100 (e.g., a homeowner, a technician equipped to service HVAC system 100, etc.). Alternatively, the temperature setpoint may be entered into a remote device (e.g., a smartphone, etc.) by the user, and/or the temperature setpoint may be adjusted automatically by system controller 106 as part of an automated control scheme or strategy of the HVAC system 100.

HVAC system 100 may be operated in the cooling mode to transfer heat from the return airflow 115 to a refrigerant circulating through indoor heat exchanger 110, thereby cooling the comfort zone 202. The amount of cooling HVAC system 100 may provide to comfort zone 202 when operating in the cooling mode may comprise a "cooling capacity" of HVAC system 100. Additionally, HVAC system 100 may be operated in the heating mode to transfer heat from the refrigerant circulating through indoor heat exchanger 110 to the supply airflow 113 provided by indoor fan 112, which may be provided to comfort zone 202 via supply duct 222. The amount of heating HVAC system 100 may provide to comfort zone 202 when operating in the heating mode may comprise a "heating capacity" of HVAC system 100.

Figure 2:
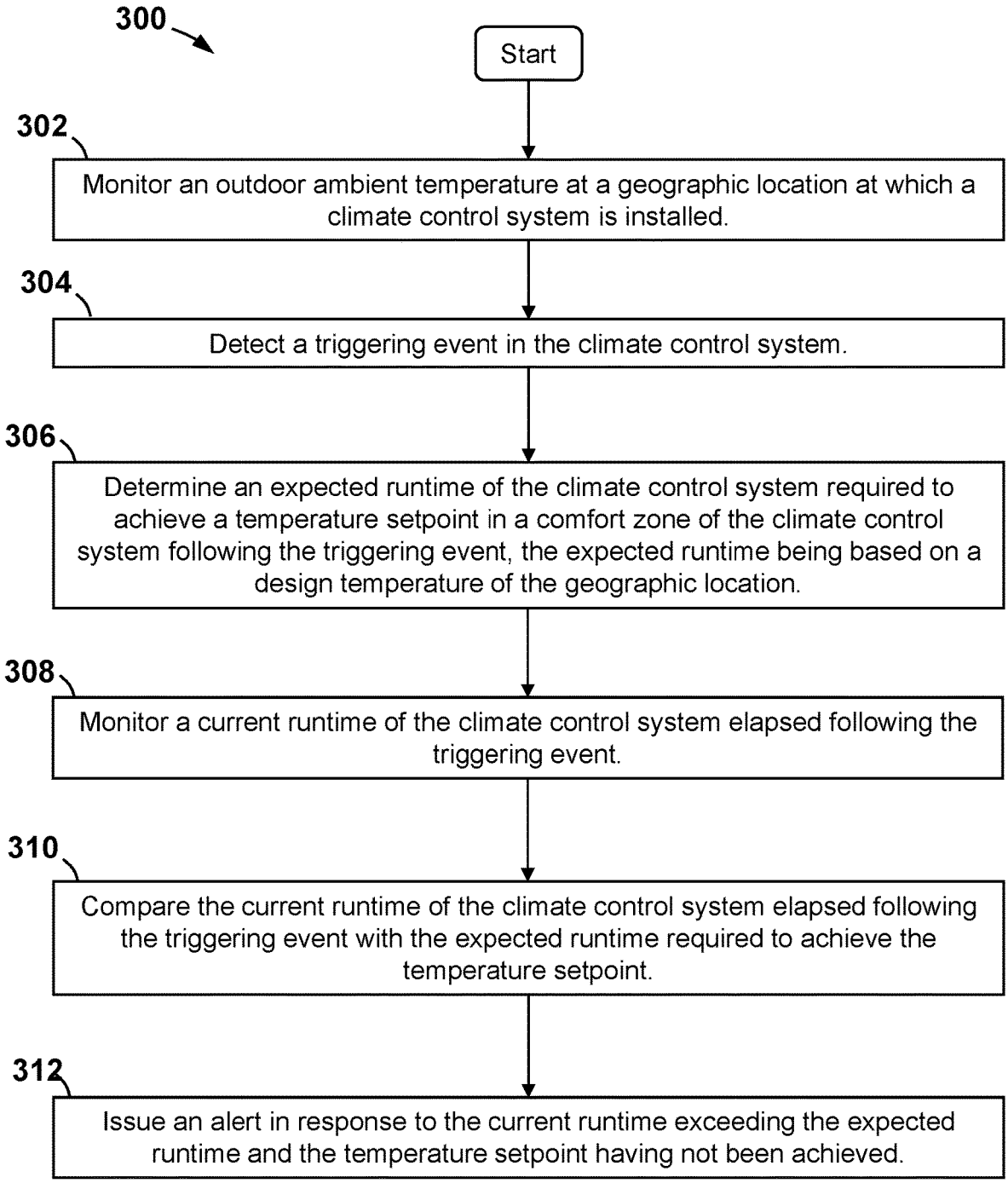
FIG. 2 is a flow chart of a method for detecting a fault in a control system according to some embodiments.

Referring now to FIG. 2, a method 300 of detecting a fault in a climate control system is shown. In some embodiments, method 300 may be practiced with HVAC system 100 shown in FIGS. 1, 5. Specifically, in some embodiments, method 300 may be performed at least partially by a remote device 130 shown in FIG. 5 in communication with a controller of HVAC system 100 via a communication network 132 also shown in FIG. 5 and which is described in further detail below. For instance, in some embodiments, remote device 130 may comprise a cloud server and method 300 may be performed at least partially by a cloud application installed on the cloud server. In some embodiments, method 300 may be performed at least partially by other components of HVAC system 100, such as, for example, controllers 124, 126, and/or I/O unit 107 (each shown in FIG. 5). However, it should be appreciated that embodiments of method 300 may be practiced with other systems, assemblies, and devices other than those described above.

Initially, method 300 includes monitoring an outdoor ambient temperature at a geographic location at which a climate control system is installed at method block 302. Method block 302 may include monitoring the outdoor ambient temperature using an outdoor temperature sensor of the climate control system. For example, block 302 may include monitoring the temperature of air in the outdoor ambient area 203 using the outdoor temperature sensor 154 shown in FIG. 1, which is proximal the external structure 12 in which the comfort zone 202 heated by HVAC system 100 is located. In some embodiments, system controller 106 of HVAC system 100 may communicate the outer ambient temperature determined by outdoor temperature sensor 154 continually (e.g., at a predetermined frequency) to remote device 130 via communication network 132, where remote device 130 may comprise a remote server including a database for recording the outdoor ambient temperature measurements. In other embodiments, instead of receiving outdoor temperature measurements from outdoor temperature sensor 154 via a communication network 132 shown in FIG. 5 and described further below, remote device 130 may be configured to continually obtain outdoor ambient temperature measurements within the vicinity (e.g., within the same ZIP or postal code) of HVAC system 100 via publicly available sources accessed using communication network 132, where communication network 132 comprises the Internet and remote device 130 comprises a remote server.

Method 300 continues at block 304 by detecting a triggering event in the climate control system. In some embodiments, the triggering event may comprise the detection of a temperature error or differential between an indoor temperature of a comfort zone of the climate control system and a temperature setpoint of the comfort zone that equals or exceeds a predetermined threshold temperature error or differential. In some embodiments, the threshold temperature differential may comprise approximately between 2° F. and 10° F.; however, the magnitude of the threshold temperature differential may vary. The existence of a temperature differential exceeding the threshold temperature differential may be indicative of a potential fault in the climate control system. As further described below, the potential fault indicated by the temperature differential exceeding the threshold temperature differential may be investigated by comparing a current runtime of the climate control system elapsed following the triggering event with an expected runtime required to achieve the temperature setpoint.

Additionally, a temperature differential exceeding the threshold differential may occur following, for instance, a change in the outdoor ambient temperature and/or a change to the temperature setpoint. For example, a temperature setpoint of the comfort zone (e.g., comfort zone 202) may be adjusted or changed from a first temperature setpoint to a second temperature setpoint that is different from the first temperature setpoint and where the differential between the second temperature setpoint and the indoor temperature equals or exceeds the threshold temperature differential. The temperature setpoint may be adjusted by a user (e.g., a homeowner, a technician equipped to service the climate control system, etc.) of the climate control system (e.g., HVAC system 100) and/or by a controller of the climate control system (e.g., system controller 106) as part of an automated control scheme of the climate control system.

Figure 3:
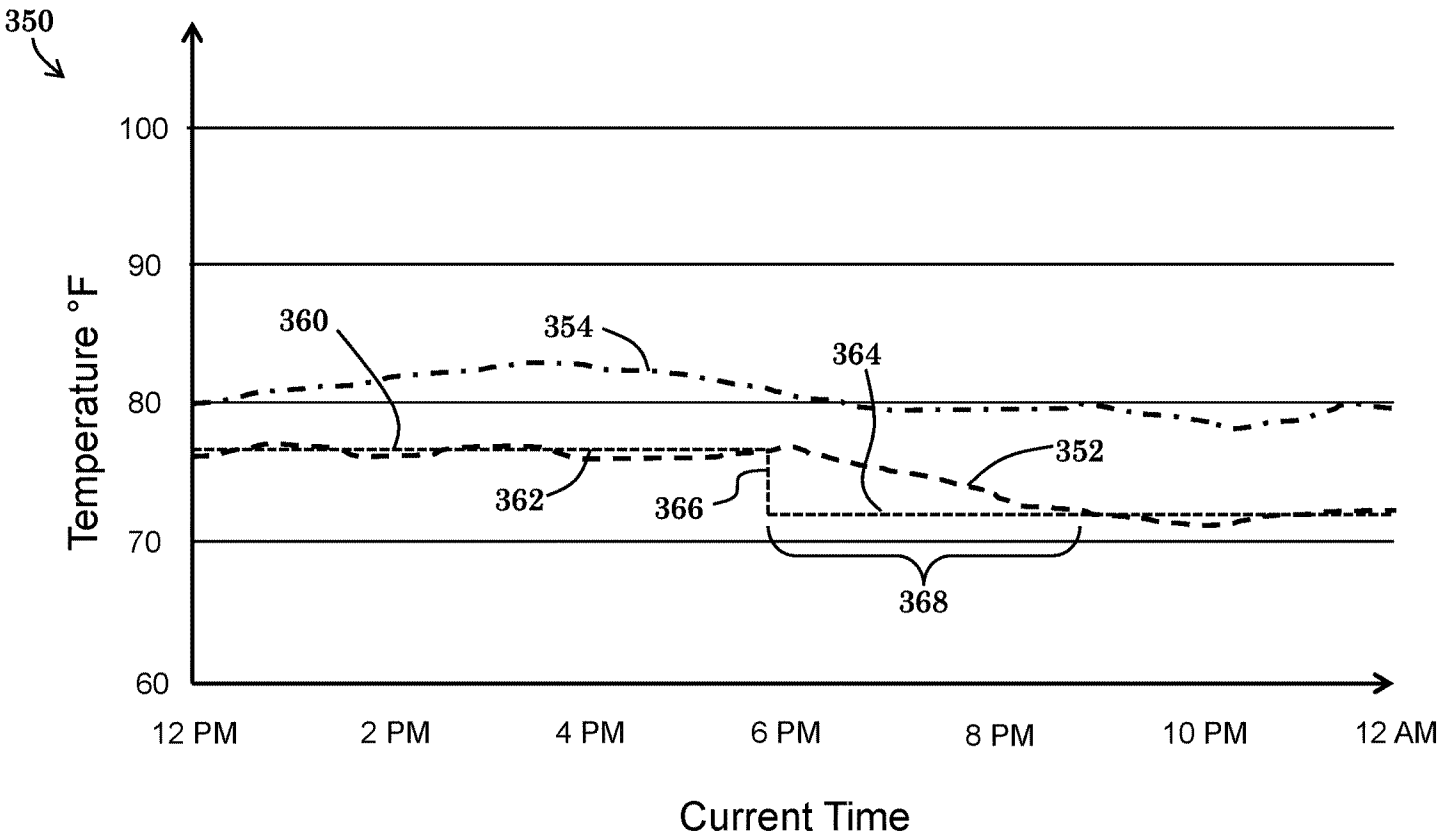
FIGS. 3, 4 are charts illustrating parameters of a climate control system according to some embodiments.

For example, referring to FIG. 3, an exemplary chart 350 is shown that illustrates parameters of a climate control system (e.g., HVAC system 100) and which comprises an X-axis indicating a current time over a given day during the operational life of the climate control system and a Y-axis indicating temperature in degrees Fahrenheit (° F.). Chart 350 indicates an indoor temperature 352 of a comfort zone (e.g., comfort zone 202 shown in FIG. 1) and an outdoor ambient temperature 354 (e.g., the temperature of outdoor ambient area 203) within the vicinity of the climate control system, where, in some embodiments, the indoor temperature 352 and outdoor ambient temperature 354 may be determined by sensors of the climate control system.

Chart 350 additionally includes a temperature setpoint 360 of the comfort zone of the climate control system over the span of time indicated on the Y-axis of chart 350. Particularly, in this example, temperature setpoint 360 comprises a first temperature setpoint 362 of approximately 76° F. and a second temperature setpoint 364 of approximately 72° F. which follows a temperature setpoint change 366 which occurs at approximately 6 PM in this example. As described above, the temperature setpoint change 366 may be provided manually by a user of the climate control system and/or automatically by a controller of the climate control system. With the outdoor ambient temperature 354 being greater than the indoor temperature 352 in this example, the climate control system may operate intermittently in the cooling mode between 12 PM and 6 PM to maintain the indoor temperature 352 at the first temperature setpoint 362. Following the temperature setpoint change 366 at approximately 6 PM, the climate control system may operate in the cooling mode to reduce the indoor temperature 352 until the second temperature setpoint 364 is achieved in the comfort zone (at approximately 9 PM in this example) whereby the indoor temperature 352 conforms to the second temperature setpoint 364. In this example, the actual runtime 368 for achieving the second temperature setpoint 364 (occurring at approximately 9 PM) following the temperature setpoint change 366 (occurring at approximately 6 PM) of approximately 4° F. is approximately three hours. In an embodiment where the threshold temperature differential equals, for example, 3° F., the temperature differential at 6 PM (approximately 4° F.) in the example of FIG. 3 would therefore exceed the threshold temperature differential and thus may comprise a triggering event in some embodiments.

Figure 4:
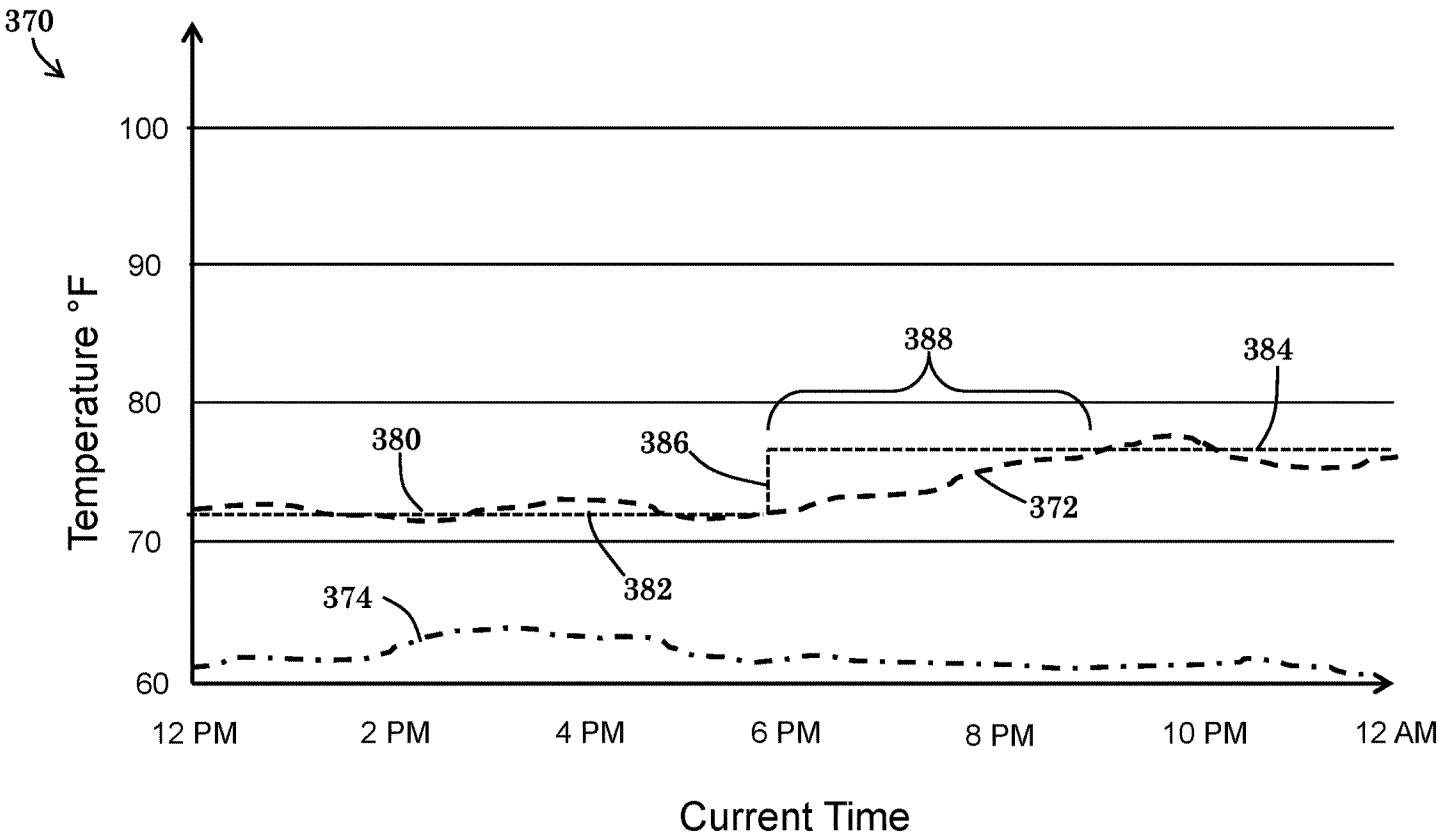

While in the exemplary chart 350 shown in FIG. 3 the climate control system is operated in the cooling mode during the actual runtime 368 to achieve the second temperature setpoint 364, in other examples the climate control system may be operated in the heating mode to achieve a temperature setpoint. For instance, referring to FIG. 4, another exemplary chart 370 is shown which indicates an indoor temperature 372 of a comfort zone (e.g., comfort zone 202 shown in FIG. 1) of an external structure, an outdoor ambient temperature 374 (e.g., the temperature of outdoor ambient area 203), and a temperature setpoint 380. In this example shown in chart 370, temperature setpoint 380 comprises a first temperature setpoint 382 of approximately 72° F. and a second temperature setpoint 384 of approximately 76° F. which follows a temperature setpoint change 386 which occurs at approximately 6 PM. With the outdoor ambient temperature 374 being less than the indoor temperature 372 in this example, the climate control system may operate intermittently in the heating mode between 12 PM and 6 PM to maintain the indoor temperature 372 at the first temperature setpoint 382. Following the temperature setpoint change 386 at approximately 6 PM, the climate control system may operate in the heating mode to increase the indoor temperature 372 until the second temperature setpoint 384 is achieved in the comfort zone (at approximately 9 PM in this example) whereby the indoor temperature 372 conforms to the second temperature setpoint 384. In this example, the actual runtime 388 for achieving the second temperature setpoint 384 (occurring at approximately 9 PM) following the temperature setpoint change 386 (occurring at approximately 6 PM) of approximately 4° F. is approximately 3 hours. In an embodiment where the threshold temperature differential equals, for example, 3° F., the temperature differential at 6 PM (approximately 4° F.) in the example of FIG. 4 would exceed the threshold temperature differential and thus may comprise a triggering event in some embodiments.

In some embodiments, a remote device (e.g., remote device 130 shown in FIG. 5) may detect the triggering event, such as a temperature differential of the comfort zone of the climate control system equaling or exceeding the threshold temperature differential. For instance, the remote device may periodically monitor, at a fixed frequency, the differential between the indoor temperature of the comfort zone (e.g., indoor temperatures 352, 372) and the temperature setpoint. Alternatively, the controller of HVAC system 100 may transmit data to the remote device indicative of a triggering event, such as a triggering event corresponding to the temperature differential between the indoor temperature of the comfort zone and the temperature setpoint equaling or exceeding the threshold temperature differential.

Referring again to FIG. 2, method 300 proceeds at method block 306 by determining an expected runtime of the climate control system required to achieve a temperature setpoint in a comfort zone of the climate control system following the triggering event, the expected runtime being based on a design temperature of a geographic location at which the climate control system is installed. In some embodiments, the expected runtime may be determined following the detection of a temperature differential equaling or exceeding the threshold temperature differential. In some embodiments, the expected runtime may be based on outdoor ambient conditions. For example, the expected runtime may be a function of the outdoor ambient temperature at the time of the triggering event, such as when a temperature differential equaling or exceeding the threshold temperature differential is detected. However, in other embodiments, an average outdoor ambient temperature following the triggering event until the climate control system achieves the temperature setpoint may be used. In other alternatives, the expected runtime may be a function of a minimum outdoor ambient temperature following the triggering event until the climate control system achieves the temperature setpoint. In another embodiment, the expected runtime is a function of at least one of a minimum outdoor ambient temperature, an average outdoor ambient temperature, a median outdoor ambient temperature, and a lowest quartile outdoor ambient temperature following the triggering event until the climate control system achieves the temperature setpoint.

In some embodiments, method block 306 may comprise a controller of the HVAC system 100 (e.g., system controller 106) and/or remote device 130 determining the expected runtime required to achieve the temperature setpoint. As an example, remote device 130 may determine an expected runtime of the HVAC system 100 for achieving the second temperature setpoint 364 (shown in FIG. 3) following the triggering event (e.g., the temperature differential of 4° F. occurring at the time of the temperature setpoint change 366 shown in FIG. 3) as a function of the outdoor temperature 354 occurring during the triggering event (6 PM in the example shown in FIG. 3).

The expected runtime determined at method block 306 may also be a function of or based on a predetermined design temperature of a geographic location at which the climate control system is installed. Particularly, the design temperature may be an outdoor design temperature of the geographic location. The outdoor design temperature may be used to estimate an expected cooling and/or heating capacity of the climate control system based on the typical outdoor ambient conditions of a geographic region at which the climate control system is installed.

Specifically, a cooling or summer outdoor design temperature corresponds to particular ambient outdoor temperature that will typically be exceeded in only 1% of the hours of a given year for the particular geographic location at which the climate control system is installed. Additionally, a heating or winter outdoor design temperature corresponds to particular ambient outdoor temperature that will typically be exceeded in 99% of the hours of a given year for the particular geographic location at which the climate control system is installed. In some embodiments, the geographic location may comprise a ZIP or postal code at which the climate control system is located. In other embodiments, the geographic location may comprise a municipality, a county, and/or other geographic designation. The cooling and heating outdoor design temperatures for a given geographic location may correspond to the average cooling outdoor design temperature and heating outdoor design temperature over a multi-decade (e.g., thirty years) period. Additionally, the cooling and/or heating outdoor design temperatures for a given geographic location may change over time (e.g., every four years) to reflect changes in outdoor ambient conditions at the geographic location over time. For example, the cooling outdoor design temperature and the heating outdoor design temperature for the city of Atlanta, Ga. (as of the year 2020) may be 91° F. and 23° F., respectively, while the cooling outdoor design temperature and the heating outdoor design temperature for the city of Boston, Mass. (as of the year 2020) may be 88° F. and 12° F., respectively.

Climate control systems may be typically sized during installation based on the cooling and heating outdoor design temperatures for the geographic location at which the climate control system will be installed. In other words, an installer may typically select a cooling and heating capacity for the climate control system to be installed as a function of the cooling and heating outdoor design temperatures for the geographic location. For example, an installer may select a climate control system to be installed at a particular geographic location having a cooling capacity sufficient to cool a comfort zone to a predetermined cooling indoor baseline temperature (e.g., 75° F. in some applications) when the outdoor ambient temperature is less than the cooling outdoor design temperature. Similarly, an installer may select a climate control system to be installed at a particular geographic location having a heating capacity sufficient for heating a comfort zone to a predetermined heating indoor baseline temperature (e.g., 70° F. in some applications) when the outdoor ambient temperature is greater than the heating outdoor design temperature. In some embodiments, the cooling and/or heating outdoor design temperatures for each geographic location may be based on or comprise the Climatic Design Conditions published periodically by the American Society of Heating, Refrigerating and Air-Conditioning Engineers (ASHRAE).

Given that the cooling and heating capacities of a given climate control system are typically a function of the cooling and heating outdoor design temperatures pertaining to the geographic location at which the climate control system is installed, the cooling and heating outdoor design temperatures of the geographic location may be used to estimate the expected cooling and heating capacities of the climate control system. In some embodiments, rather than basing the expected runtime required to achieve a temperature setpoint on the particular cooling or heating capacity of a given climate control system, remote device 130 may determine the expected runtime based on the cooling and/or heating design temperatures for the geographic location at which the climate control system is installed. In this manner, remote device 130 need only know the geographic location at which the climate control system is located, not the particular design characteristics of the climate control system (e.g., the sizing of the climate control system), in order to estimate the expected cooling and/or heating capacities of the climate control system.

In some conventional systems, an expected runtime required to achieve a temperature setpoint may only be estimated based on the specifications of the specific climate control system being monitored such as, for example, the size or tonnage of the climate control system, the capacity of a furnace of the climate control system, the size of the indoor space and/or the insulating properties of the external structure. However, information pertaining to the specifications of individual climate control systems may be difficult to acquire and cumbersome to maintain, increasing the difficulty and costs associated with detecting faults in climate control systems through the estimation of an expected runtime required for the climate control system to achieve a temperature setpoint. By utilizing the design temperature of the geographic location at which the climate control system is installed, an expected runtime required for the climate control system to achieve a temperature setpoint may be estimated without having any information pertaining to the specifications of the climate control system being monitored other than the geographic location of the climate control system. In this manner, the amount of information required for estimating an expected runtime of a climate control system required to achieve a temperature setpoint may be minimized, in-turn minimizing the costs and complexity associated with estimating the expected runtime of the climate control system.

The expected runtime determined at method block 306 may also be based on the magnitude of the detected temperature differential between the indoor temperature and the temperature setpoint of the comfort zone. Not intending to be bound by any theory, an expected runtime required to achieve the temperature setpoint may be determined in accordance with the following computation, where $ReqRuntime_{exp}$ comprises the expected runtime required to achieve a temperature setpoint ($T_{set}$) following a triggering event, ScalingFactor comprises a scaling factor based on the outdoor ambient temperature and the design temperature of the geographic location at which the climate control system is installed, IDT comprises an indoor temperature of the comfort zone at the time of the triggering event, and $C_1$ is a predetermined constant having units of temperature over time (e.g., $\frac{(^{o}\ F.)}{(\text{hours})}$).

):

$$ReqRuntime_{exp} = ScalingFactor * \left(\frac{(IDT - T_{set})}{C_1}\right) \quad (1)$$

In Equation (1) above, $IDT-T_{set}$ comprises the temperature differential between the IDT and the $T_{set}$ of the comfort zone of the climate control system at the time the triggering event occurs. Thus, the greater the temperature differential, the longer the $ReqRuntime_{exp}$ to achieve the $T_{set}$. In some embodiments, a single $ReqRuntime_{exp}$ may be determined following the triggering event until a subsequent triggering event occurs, and thus changes in, for example, the IDT and/or the outdoor ambient conditions occurring after the triggering event may not affect the $ReqRuntime_{exp}$ determined following the original triggering event. Changes to the $ReqRuntime_{exp}$ following its original determination may be generally restricted in some embodiments in order to prevent, for example, a continued increase in the temperature differential following the triggering event from leading to an increase in the $ReqRuntime_{exp}$, which could prevent an alert from being issued to a user of the climate control system even though the increasing temperature differential is due to a fault in the climate control system.

Constant $C_1$ of Equation (1) may comprise a calibration factor corresponding to the amount of time required for each degree of temperature change of the IDT of a climate zone for a properly installed (e.g., having cooling and heating capacities commensurate with the summer and winter outdoor design temperatures at the geographic location at which the climate control system is installed) and functioning climate control system. In some embodiments, constant C may be approximately between 1° F. and 3° F. per hour. The IDT of the climate control system may be determined by one or more indoor temperature sensors of the climate control system. As described above, the $T_{set}$ may be provided manually by a user of the climate control system and/or automatically by a controller of the climate control system. In some embodiments, a controller (e.g., system controller 106) may communicate (via, e.g., communication network 132) the IDT and the $T_{set}$ of the climate control system at the time the triggering event occurred. However, in other embodiments, the controller of the climate control system may first determine the $ReqRuntime_{exp}$ following the triggering event and then communicate the $ReqRuntime_{exp}$ to the remote device.

ScalingFactor is a factor that scales or adjusts the $ReqRuntime_{exp}$ of Equation (1) in view of the outdoor ambient temperature at the time of the triggering event, and the outdoor design temperature of the geographic location at which the climate control system is installed. ScalingFactor may be a function (linear or nonlinear) or may be determined from a look-up table stored in the memory of a remote device (e.g., remote device 130) and/or a controller of the climate control system (e.g., system controller 106).

For example, not intending to be bound by any theory, the ScalingFactor of Equation (1) may be determined in accordance with the following nonlinear function, where DT comprises the outdoor design temperature of the geographic location at which the climate control system is installed, the OT comprises an outdoor ambient temperature, and $C_2$ is a predetermined, dimensionless constant:

$$ScalingFactor = \sqrt[4]{\frac{(|DT - OT|)}{C_2}} \quad (2)$$

The OT of Equation (2) may comprise the outdoor ambient temperature at the geographic location of the climate control system at the time the triggering event occurs, and may be measured by an outdoor temperature sensor of the climate control system and/or may be obtained from a third party source of information, such as the Internet. Constant $C_2$ of Equation (2) may comprise a curve fit factor used to shape the ScalingFactor function. The climate control system may not have sufficient cooling capacity to cool the comfort zone of the climate control system to the baseline indoor temperature when either the outdoor ambient temperature is greater than the cooling outdoor design temperature or less than the heating outdoor design temperature. Thus, when either the outdoor ambient temperature is greater than the cooling outdoor design temperature or less than the heating outdoor design temperature, Equations (1) and (2) above may provide a $ReqRuntime_{exp}$ of twenty four hours, indicating that the climate control system would be expected to run the entire day.

In some embodiments, the DT (cooling and/or heating outdoor design temperatures) of the climate control system may be pre-stored in a memory of a remote device (e.g., remote device 130), and thus remote device may look-up the DT of the geographic location at which the climate control system is installed from the memory of the remote device when determining the $ReqRuntime_{exp}$ for the climate control system following the triggering event. In other embodiments, only a geographic location of the climate control system may be stored in the memory of the remote device (upon or following installation of the climate control system) and remote device may look-up the DT for the geographic location using a third party source of information, such as the Internet. For instance, the remote device may, using the Internet, look-up the cooling and/or heating outdoor design temperature for the particular geographic location from the Climatic Design Conditions published by ASHRAE. In some embodiments, a user of the climate control system (e.g., a homeowner, an installer of the climate control system, etc.) may input the geographic location (e.g., the ZIP code, etc.) at which the climate control system is installed to the remote device at or following the installation of the climate control system.

As described above, ScalingFactor may also comprise a linear function. For example, not intending to be bound by any theory, the ScalingFactor of Equation (1) may be determined in accordance with the following linear function, $C_3$ is a predetermined, dimensionless constant:

$$ScalingFactor = \frac{(|DT - ODT|)}{C_3} \quad (3)$$

In some embodiments, Equations (1), (2), and/or (3), including constants $C_1$-$C_3$ may be stored in a memory of a remote device (e.g., remote device 130). The remote device may determine the expected runtime required to achieve the temperature setpoint following the triggering event. In other embodiments, the controller of the climate control system (e.g., system controller 106) may determine the expected runtime required to achieve the temperature setpoint.

Method 300 proceeds at method block 308 by monitoring a current runtime of the climate control system elapsed following the triggering event, such as the detection of a temperature differential which equals or exceeds the threshold temperature differential. The indoor temperature of the comfort zone may also be monitored following the detection of the triggering event. In some embodiments, a remote device (e.g., remote device 130 shown in FIG. 5) may monitor the indoor temperature and/or the current runtime elapsed following the detection of the triggering event. For instance, the remote device may periodically monitor, at a fixed frequency, the indoor temperature and/or the current runtime of the climate control system following the detection of the triggering event.

Method 300 continues at method block 310 by comparing the current runtime of the climate control system (monitored at method block 308) elapsed following the triggering event with the expected runtime required to achieve the temperature setpoint (determined at method block 306). Not intending to be bound by any theory, method block 310 may compare the current runtime and the expected runtime in accordance with the following relationship, where $Runtime_{cur}$ comprises the current runtime of the climate control system following the detection of the triggering event:

$$Runtime_{cur} > ReqRuntime_{exp} \quad (4)$$

Thus, in accordance with Equation (4), the $Runtime_{cur}$ monitored at method block 308 above may be compared with the $ReqRuntime_{exp}$ determined in accordance with Equations (1), (2), and/or (3) above at method block 306. In some embodiments, Equations (1), (2), (3), and/or (4) may be stored in a memory of a remote device (e.g., remote device 130). The remote device may thus compare the current runtime elapsed following the triggering event with the expected runtime required to achieve the temperature setpoint. In other embodiments, the controller of the climate control system (e.g., system controller 106 of HVAC system 100) may compare the current runtime elapsed following the detection of the temperature differential at method block 304 with the expected runtime.

Method 300 continues at block 312 by issuing an alert to a user of the climate control system in response to the current runtime exceeding the expected runtime and the temperature setpoint having not been achieved. Block 312 may include issuing an alert to the user of the climate control system (e.g., a homeowner, a technician or dealer of the climate control system, etc.) in response to Equation (4) presented above being true and the temperature setpoint having not been achieved in the comfort zone. The alert may notify the user of the climate control system that a fault has occurred in the climate control system, preventing the climate control system from achieving the temperature setpoint over an elapsed runtime equal to or less than the expected runtime. For instance, the alert may notify the user of the climate control system that at least some of the cooling and/or heating capacity of the climate control system has been lost as indicated by the actual runtime being greater than the expected runtime.

As described above, the outdoor ambient conditions may exceed the cooling and/or heating capacity of the climate control system to maintain the baseline indoor temperature when either the outdoor ambient temperature is greater than the cooling outdoor design temperature or less than the heating outdoor design temperature, and thus the $ReqRuntime_{exp}$ may comprise the entire day when either of these conditions occur. When the $ReqRuntime_{exp}$ comprises an entire daily period the current runtime for the day may thus not exceed $ReqRuntime_{exp}$ the and thus an alert may not be issued to the user of the climate control system even if the climate control system runs for the entire day. False alerts erroneously indicating a fault in the climate control system may therefore be avoided by basing the $ReqRuntime_{exp}$ on the outdoor ambient temperature and the design temperature of the geographic location at which the climate control system is installed.

In some embodiments, the alert may be issued to or by systems remote of the climate control system which monitor the climate control system. For example, the alert may be issued by a remote device (e.g., remote device 130) to personnel equipped to repair or perform maintenance on the climate control system in response to receiving the alert. In other embodiments, a controller of the climate control system (e.g., system controller 106) may issue the alert to an occupant of the structure heated by the climate control system (e.g., a homeowner).

In some embodiments, the remote device may continuously monitor one or more climate control systems simultaneously. Particularly, the remote device may perform one or more of the method blocks 306-312 of method 300 following the detection of a triggering event in the one or more climate control systems monitored by the remote device. The remote device may be in signal communication (e.g., via communication network 132) with a controller of each of the one or more climate control systems monitored by the remote device, and may receive information from each controller pertaining to the indoor temperature and the temperature setpoint for the comfort zone of the one or more climate control systems. In some embodiments, the remote device may issue the alert at method block 312 through the controller of the climate control system or directly to the user of the climate controller system (e.g., via communication network 132).

Referring now to FIG. 5, a schematic diagram of the climate control system 100 referred to above, and which may be used to at least partially implement method 300 described above, is shown. In this embodiment, the HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor metering device 108, indoor heat exchanger 110, indoor fan 112, and an indoor controller 124. The indoor metering device 108 may generally comprise an electronically-controlled motor-driven electronic expansion valve (EEV). In some embodiments, however, the indoor metering device 108 may comprise a thermostatic expansion valve, a capillary tube assembly, and/or any other suitable metering device. In some embodiments, while the indoor metering device 108 may be configured to meter the volume and/or flow rate of refrigerant through the indoor metering device 108, the indoor metering device 108 may also comprise and/or be associated with a refrigerant check valve and/or refrigerant bypass configuration when the direction of refrigerant flow through the indoor metering device 108 is such that the indoor metering device 108 is not intended to meter or otherwise substantially restrict flow of the refrigerant through the indoor metering device 108.

The indoor heat exchanger 110 of indoor unit 102 may generally be configured to promote heat exchange between refrigerant carried within internal tubing of the indoor heat exchanger 110 and an airflow that may contact the indoor heat exchanger 110 but that is segregated from the refrigerant. In some embodiments, the indoor heat exchanger 110 may comprise a plate-fin heat exchanger. However, in other embodiments, indoor heat exchanger 110 may comprise a microchannel heat exchanger and/or any other suitable type of heat exchanger.

The indoor fan 112 of indoor unit 102 may generally comprise a centrifugal blower comprising a blower housing, a blower impeller at least partially disposed within the blower housing, and a blower motor configured to selectively rotate the blower impeller. The indoor fan 112 may generally be configured to provide supply airflow 113 over the indoor heat exchanger 110 to promote heat transfer between the supply airflow 113 and a refrigerant flowing through the indoor heat exchanger 110.

Outdoor unit 104 generally comprises an outdoor heat exchanger 114, a compressor 116, an outdoor fan 118, an outdoor metering device 120, a reversing valve 122, an outdoor controller 126, and outdoor temperature sensor 154. The outdoor heat exchanger 114 may generally be configured to promote heat transfer between a refrigerant carried within internal passages or tubing of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally be configured to selectively pump refrigerant at a plurality of mass flow rates through the indoor unit 102, the outdoor unit 104, and/or between the indoor unit 102 and the outdoor unit 104. The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or over the outdoor heat exchanger 114 to promote heat transfer between the airflow and a refrigerant flowing through the outdoor heat exchanger 114.

The outdoor metering device 120 may generally comprise a thermostatic expansion valve. In some embodiments, however, the outdoor metering device 120 may comprise an electronically-controlled motor driven EEV similar to indoor metering device 108, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flow path of refrigerant through the reversing valve 122 and consequently the HVAC system 100. Additionally, the reversing valve 122 may also be selectively controlled by the system controller 106 and/or an outdoor controller 126.

Outdoor temperature sensor 154 may comprise any suitable device or collection of devices for determining a temperature (or value(s) indicative thereof) for an environment surrounding the outdoor temperature sensor 154. For instance, outdoor temperature sensor 154 may comprise a thermocouple, thermistor, infrared sensor, etc. In some embodiments, in addition to outdoor temperature sensor 154, the outdoor unit 104 may also comprise a plurality of temperature sensors for measuring the temperature of the outdoor heat exchanger 114, and/or the compressor 116. In still other embodiments, outdoor unit 102 may not include outdoor temperature sensor 154.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 through the indoor controller 124 and/or the outdoor unit 104 through the outdoor controller 126. In some embodiments, the system controller 106 may be configured to monitor and/or communicate, directly or indirectly, with a plurality of sensors associated with components of the indoor unit 102, the outdoor unit 104, etc. The sensors may measure or detect a variety of parameters, such as, for example, pressure, temperature, and flow rate of the refrigerant as well as pressure and temperature of other components or fluids of or associated with HVAC system 100. For example, system controller 106 may be in signal communication with outdoor temperature sensor 154 whereby system controller 106 may monitor ambient outdoor temperature. Additionally, in some embodiments, the system controller 106 may be configured to control cooling and/or heating of zones associated with the HVAC system 100 (e.g., within the indoor space).

The system controller 106 may also be in communication with or incorporated with an input/output (I/O) unit 107 (e.g., a graphical user interface, a touchscreen interface, or the like) for displaying information and for receiving user inputs. The I/O unit 107 may display information related to the operation of the HVAC system 100 (e.g., from system controller 106) and may receive user inputs related to operation of the HVAC system 100. For example, a user of HVAC system 100 (e.g., a homeowner and/or installer of HVAC system 100) may enter into I/O unit 107 a user defined temperature setting or setpoint for an indoor space. During operations, I/O unit 107 may communicate received user inputs to the system controller 106, which may then execute control of HVAC system 100 accordingly. Communication between the I/O unit 107 and system controller 106 may be wired, wireless, or a combination thereof. The I/O unit 107 may be positioned within the comfort zone 202 and may comprise one or more sensors, such as temperature or humidity sensors, for monitoring respective characteristics of the indoor space.

In some embodiments, the system controller 106 may be configured for selective bidirectional communication over a communication bus 128. Further, the system controller 106 may be configured to selectively communicate with HVAC system 100 components and/or remote device 130 via communication network 132. In some embodiments, the communication network 132 may comprise the Internet, and the remote device 130 may comprise a remote server, such as a cloud server having a cloud application installed that is configured to process information pertaining to plurality of climate control systems, including HVAC system 100. For instance, the cloud application may store data pertaining to actual and expected runtimes (determinable, e.g., via method 300 shown in FIG. 2) of the climate control system required to achieve a temperature setpoint in a comfort zone of the climate control system. The cloud application may be accessible from a plurality of devices via the communication network 132. Additionally, the cloud application may reside and execute on one or more cloud servers.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to receive information related to the operation of components of indoor unit 102 (e.g., indoor metering device 108, indoor heat exchanger 110, indoor fan 112, auxiliary heat source 150, etc.) and to transmit control outputs or otherwise affect control over components of indoor unit 102.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to receive information related to the status and/or operation of components of outdoor unit 104 (e.g., outdoor heat exchanger 114, compressor 116, outdoor fan 118, outdoor metering device 120, and reversing valve 122, etc.) and to transmit control outputs or otherwise affect control over components of outdoor unit 104.

System controller 106, indoor controller 124, outdoor controller 126, and remote device 130 may each comprise any suitable device or assembly which is capable of receiving electrical (or other data) signals and transmitting electrical (or other data) signals to other devices. In particular, while not specifically shown, system controller 106, indoor controller 124, and outdoor controller 126 (as well as remote device 130) may each include a processor and a memory. As an example, system controller 106 may comprise a processor 109 and a memory 111. The processors (e.g., microprocessor, central processing unit, or collection of such processor devices, etc.) of controllers 106, 124, and 126 may execute machine readable instructions (e.g., a non-transitory machine readable medium) provided on the corresponding memory to provide the processor (e.g., processor 109) with all of the functionality described herein. The memory (e.g., memory 111) of controllers 106, 124, 126 may comprise volatile storage (e.g., random access memory), non-volatile storage (e.g., flash storage, read only memory, etc.), or combinations of both volatile and non-volatile storage. Data consumed or produced by the machine readable instructions can also be stored on the memory of controllers 106, 124, 126. Additionally, controllers 106, 124, and 126 may each comprise a singular controller or control board or may comprise a plurality of controllers or control boards that are coupled to one another. Further, controllers 106, 124, and 126 may each comprise one or more flexible printed circuit boards (PCB) and/or one or more rigid PCBs with flexible or rigid connections therebetween.

As shown in FIG. 5, the HVAC system 100 is configured for operating in a so-called cooling mode in which heat may generally be absorbed by refrigerant at the indoor heat exchanger 110 and rejected from the refrigerant at the outdoor heat exchanger 114. Starting at the compressor 116, the compressor 116 may be operated to compress refrigerant and pump the relatively high temperature and high pressure compressed refrigerant through the reversing valve 122 and to the outdoor heat exchanger 114, where the refrigerant may transfer heat to an airflow that is passed through and/or into contact with the outdoor heat exchanger 114 by the outdoor fan 118. After exiting the outdoor heat exchanger 114, the refrigerant may flow through and/or bypass the outdoor metering device 120, such that refrigerant flow is not substantially restricted by the outdoor metering device 120. Refrigerant generally exits the outdoor metering device 120 and flows to the indoor metering device 112, which may meter the flow of refrigerant through the indoor metering device 112, such that the refrigerant downstream of the indoor metering device 112 is at a lower pressure than the refrigerant upstream of the indoor metering device 112. From the indoor metering device 112, the refrigerant may enter the indoor heat exchanger 110. As the refrigerant is passed through coil of the indoor heat exchanger 110, heat may be transferred to the refrigerant from an airflow that is passed through and/or into contact with the indoor heat exchanger 110. Refrigerant leaving the indoor heat exchanger 110 may flow to the reversing valve 122, where the reversing valve 122 may be selectively configured to divert the refrigerant back to the compressor 116, where the refrigeration cycle may begin again.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 110 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may re-enter the compressor 116 after passing through the reversing valve 122. Most generally, operation of the HVAC system 100 in the heating mode reverses the roles of the indoor heat exchanger 110 and the outdoor heat exchanger 114 as compared to their operation in the cooling mode. Thus, in the heating mode, heat is transferred from the refrigerant to an airflow that is passed through and/or into contact with the indoor heat exchanger 110, the airflow being produced by the indoor fan 112.

As described above, through use of the systems (e.g., HVAC system 100) and methods (e.g., method 300) described herein, a fault in a climate control system, such as a loss of at least some cooling and/or heating capacity from a climate control system, may be detected by comparing a current runtime of the climate control system elapsed following a triggering event with an expected runtime of the climate control system required to achieve a temperature setpoint following the triggering event. As described above, the expected runtime may be a function of outdoor ambient conditions and a design temperature of a geographic location at which the climate control system is installed. The above described systems and methods allow for an expected cooling and/or heating capacity of the climate control system to be estimated based on the geographic location of the climate control system. In other words, the expected cooling and/or heating capacity of the climate control system may be determined using the typical outdoor ambient conditions of the geographic location at which the climate control system is installed. In this manner, an expected cooling and/or heating capacity of the climate control system may be determined without knowledge of the actual configuration (e.g., the size of an indoor and/or outdoor unit of the climate control system) of the climate control system, simplifying the process of determining the expected runtime.

Accordingly, a climate control system utilizing the above described systems and methods may be operated whereby a user of the climate control system may be issued an alert notifying the user of a fault in the climate control system, such as a loss of at least some cooling and/or heating capacity from the climate control system indicated by a current runtime of the climate control system elapsed following the triggering event exceeding the expected runtime of the climate control system and the temperature setpoint in the comfort zone having not been achieved.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method of detecting a fault in a heating, ventilation, and air conditioning (HVAC) system, the method comprising:

(a) determining an expected runtime of the HVAC system required to achieve a temperature setpoint in a comfort zone of the HVAC system following a triggering event, wherein the expected runtime is based on an indoor temperature of the comfort zone at the time of the triggering event and a scaling factor based on an outdoor ambient temperature and a design temperature of a geographic location at which the HVAC system is installed, wherein the triggering event comprises a detection of a temperature differential between the indoor temperature of the comfort zone and the temperature setpoint which equals or exceeds a predetermined threshold temperature differential;

(b) monitoring a current runtime of the HVAC system elapsed following the triggering event until the temperature setpoint is achieved;

(c) comparing the expected runtime with the current runtime of the HVAC system elapsed following the triggering event; and (d) issuing an alert to a user of the HVAC system a fault exists in the system in response to the current runtime exceeding the expected runtime and the temperature setpoint having not been achieved in the comfort zone, wherein the fault is one of either a loss of refrigerant and a malfunctioning compressor.

2. The method of claim 1, wherein the design temperature comprises at least one of an ambient outdoor temperature exceeded in 1% of the hours during the year at the geographic location and an ambient outdoor temperature exceeded in 99% of the hours during the year at the geographic location.

3. The method of claim 1, wherein the design temperature comprises at least one of a winter outdoor design temperature and a summer outdoor design temperature of the geographic location.

4. The method of claim 1, wherein the expected runtime is a function of the outdoor ambient temperature.

5. The method of claim 1, wherein the expected runtime is determined using the following relationship:

$$ScalingFactor*\left(\frac{(IDT - T_{set})}{C_1}\right),$$

where the ScalingFactor comprises the scaling factor, IDT comprises an indoor temperature of the comfort zone, $T_{set}$ comprises the temperature setpoint, and $C_1$ is a predetermined constant.

6. The method of claim 5, wherein the ScalingFactor is determined using the following relationship:

$$\sqrt[4]{\frac{(|DT - OT|)}{C_2}},$$

where the DT comprises the design temperature, the OT comprises an outdoor ambient temperature, and the $C_2$ is a predetermined constant.

7. The method of claim 5, wherein the ScalingFactor is determined using the following relationship:

$$\frac{(|DT - OT|)}{C_3},$$

where the DT comprises the design temperature of the HVAC system, the OT comprises an outdoor ambient temperature, and the $C_3$ is a predetermined constant.

8. The method of claim 1, wherein the expected runtime comprises twenty four hours when at least one of the design temperature comprises a summer outdoor design temperature and the outdoor ambient temperature is greater than the summer outdoor design temperature, and the design temperature comprises a winter outdoor design temperature and the outdoor ambient temperature is less than the winter outdoor design temperature.

9. A non-transitory machine-readable medium including instructions that, when executed by a processor, cause the processor to:

determine an expected runtime of a heating, ventilation, and air conditioning (HVAC) system required to achieve a temperature setpoint in a comfort zone of the HVAC system elapsed following a triggering event, wherein the expected runtime is based on an indoor temperature of the comfort zone at the time of the triggering event and a scaling factor based on an outdoor ambient temperature and a design temperature, wherein the triggering event comprises a detection of a temperature differential between the indoor temperature of the comfort zone and the temperature setpoint which equals or exceeds a predetermined threshold temperature differential;

monitor a current runtime of the HVAC system elapsed following the triggering event;

compare the expected runtime with the current runtime of the HVAC system elapsed following the triggering event; and issue an alert to a user of the HVAC system a fault exists in the system in response to the current runtime exceeding the expected runtime and the temperature setpoint having not been achieved in the comfort zone, wherein the fault is one of either a loss of refrigerant and a malfunctioning compressor.

10. The non-transitory machine-readable medium of claim 9, wherein the design temperature comprises at least one of an ambient outdoor temperature exceeded in 1% of the hours during the year at the geographic location and an ambient outdoor temperature exceeded in 99% of the hours during the year at the geographic location.

11. The non-transitory machine-readable medium of claim 9, wherein the design temperature comprises at least one of a winter outdoor design temperature and a summer outdoor design temperature of the geographic location.

12. The non-transitory machine-readable medium of claim 9, wherein the expected runtime is a function of the outdoor ambient temperature.

13. The non-transitory machine-readable medium of claim 9, wherein the expected runtime comprises twenty four hours when at least one of the design temperature comprises a summer outdoor design temperature and the outdoor ambient temperature is greater than the summer outdoor design temperature, and the design temperature comprises a winter outdoor design temperature and the outdoor ambient temperature is less than the winter outdoor design temperature.

14. A non-transitory machine-readable medium including instructions that, when executed by a processor, cause the processor to:

determine an expected runtime of a heating, ventilation, and air conditioning (HVAC) system required to achieve a temperature setpoint in a comfort zone of the HVAC system elapsed following a triggering event, wherein the expected runtime is based on a design temperature of a geographic location at which the HVAC system is installed and is determined using the following relationship:

$$ScalingFactor*\left(\frac{(IDT - T_{set})}{C_1}\right),$$

where the ScalingFactor comprises a scaling factor, wherein the scaling factor is based on an outdoor ambient temperature and the design temperature, IDT comprises an indoor temperature of the comfort zone, $T_{set}$ comprises the temperature setpoint, and $C_1$ is a predetermined constant;

monitor a current runtime of the HVAC system elapsed following the triggering event;

compare the expected runtime with the current runtime of the HVAC system elapsed following the triggering event; and issue an alert to a user of the HVAC system a fault exists in the system in response to the current runtime exceeding the expected runtime and the temperature setpoint having not been achieved in the comfort zone.

15. The non-transitory machine-readable medium of claim 14, wherein the ScalingFactor is determined using the following relationship:

$$\frac{(|DT - OT|)}{C_3},$$

where the DT comprises the design temperature of the HVAC system, the OT comprises the outdoor ambient temperature, and the $C_3$ is a predetermined constant.

16. The non-transitory machine-readable medium of claim 14, wherein the ScalingFactor is determined using the following relationship:

$$\frac{(|DT - OT|)}{C_3},$$

where the DT comprises the design temperature of the HVAC system, the OT comprises the outdoor ambient temperature, and the $C_3$ is a predetermined constant.

* * * * *